US008669469B2

(12) United States Patent
Aström et al.

(10) Patent No.: US 8,669,469 B2
(45) Date of Patent: Mar. 11, 2014

(54) COOLING OF HIGH VOLTAGE DEVICES

(75) Inventors: Urban Aström, Saxdalen (SE); Dan Gustavsson, Ludvika (SE); Fredrik Petrisi, Ludvika (SE); Peter Sjöberg, Ludvika (SE); Lars Svedjehed, Umeå (SE)

(73) Assignee: ABB Technology Ltd., Zürich (CH)

( * ) Notice: Subject to any disclaimer, the term of this patent is extended or adjusted under 35 U.S.C. 154(b) by 796 days.

(21) Appl. No.: 12/159,758

(22) PCT Filed: Dec. 22, 2006

(86) PCT No.: PCT/SE2006/001490

§ 371 (c)(1),
(2), (4) Date: Dec. 19, 2008

(87) PCT Pub. No.: WO2007/078238

PCT Pub. Date: Jul. 12, 2007

(65) Prior Publication Data

US 2009/0126965 A1 May 21, 2009

Related U.S. Application Data

(60) Provisional application No. 60/754,654, filed on Dec. 30, 2005.

(30) Foreign Application Priority Data

Aug. 25, 2006 (WO) ..... PCT/SE2006/000977

(51) Int. Cl.
*H01B 17/54* (2006.01)

(52) U.S. Cl.
USPC ..... 174/15.3

(58) Field of Classification Search
USPC ..... 174/73.1, 15.1, 15.3
See application file for complete search history.

(56) References Cited

U.S. PATENT DOCUMENTS

| | | | | |
|---|---|---|---|---|
| 1,706,810 | A | 3/1929 | Paul | |
| 1,983,371 | A | 12/1934 | Hillebrand | |
| 2,953,629 | A | 9/1960 | Lapp | |
| 3,486,064 | A * | 12/1969 | Stauffer | 313/231.01 |
| 3,564,386 | A | 2/1971 | Leonard | |
| 4,169,965 | A * | 10/1979 | Cronin | 174/15.3 |
| 4,358,631 | A | 11/1982 | Matsuda | |

FOREIGN PATENT DOCUMENTS

SU 847380 7/1981

OTHER PUBLICATIONS

PCT/ISA/210—International Search Report—Apr. 2, 2007.

(Continued)

*Primary Examiner* — Chau Nguyen
(74) *Attorney, Agent, or Firm* — Venable LLP; Eric J. Franklin

(57) ABSTRACT

A high voltage bushing including an electrical conductor configured to be electrically connected to a high voltage device and configured to be connected to an external fluid cooling system, and an insulating body surrounding the electrical conductor. A method includes cooling the high voltage bushing by connecting the electrical conductor to an external fluid cooling system.

18 Claims, 4 Drawing Sheets

(56) References Cited

OTHER PUBLICATIONS

PCT/IPEA/409—International Preliminary Report on Patentability—Feb. 14, 2008.
PCT/IPEA/408—Written Opinon of the International Preliminary Examining Authority—Dec. 7, 2007.
Extended European Search Report issued by the European Patent Office on Dec. 12, 2012, in connection with counterpart European Patent Application No. 06 83 5899.
Decision on Grant issued by the Federal Service on Industrial Property, Patents and Trade Marks in counterpart Russian Application No. 2008131323.

* cited by examiner

COOLING OF HIGH VOLTAGE DEVICES

CROSS-REFERENCE TO RELATED APPLICATIONS

This application claims priority to U.S. provisional patent application 60/754,654 filed 30Dec. 2005 and international patent application PCT/SE2006/000977 filed 25 Aug. 2006and is the national phase under 35 U.S.C. §371 of PCT/SE2006/001490 filed 22 Dec. 2006.

FIELD OF THE INVENTION

The present invention relates to the field of electrical power distribution systems and cooling of high voltage devices in such power distribution systems. In particular, the invention relates to cooling of bushings utilized within such systems. The invention is also related to a corresponding method.

BACKGROUND OF THE INVENTION

Electrical equipment and devices, and in particular high voltage equipment in an electrical power distribution system, have high heat dissipation and therefore require adequate cooling. For example, a conventional HVDC (High-Voltage Direct Current) converter valve may be air insulated and water-cooled. A cooling system is conventionally provided comprising for example cooling water distribution pipes that are shaped to fulfill certain requirements. Another example of an external cooling system is the use of fans.

However, there are also electrical devices within a power distribution system that are not cooled by any external cooling system. Those devices, lacking an external cooling system, are then instead only self-cooled, i.e. natural convective air-cooling. One example of such a self-cooled device is high voltage bushings, for example a converter transformer bushing.

Typical voltage levels within electrical power distribution systems range up to about 500 kV DC. However, the voltage levels increases constantly and may amount to as much as 800 kV DC and presumably even higher voltage levels in the future. Also, current levels may be up to 4000-5000 A or even higher. Naturally, such high voltages and current levels result in still higher heat dissipation and the requirements on electrical insulation of the bushing become extremely high. The size of the electrical insulation limits the cooling efficiency of the bushing, since the heat has to be led a longer distance to the ambient cooling air due to its increased size. The self-cooling is thus rendered insufficient at the very high voltage and current levels.

It would be feasible to utilize larger conductors when increasing the voltage levels, thereby lowering the heat dissipated, but this would again entail enlarging the equipment. That is, the size of the insulation would still be large.

Patent publication U.S. Pat. No. 2,953,629 is directed towards preventing flashovers in a condenser bushing, but also describes an attempt to cool bushings by means of a forced cooling mechanism. The cooling mechanism consists in sealing a fluid, such as water, within a bore of a central conductor. When the condenser bushing becomes heated, the liquid boils and vapor rises up and condense, whereupon the condensate returns to the bottom of the conductor. Heat is then transferred from the interior of the bushing through heat exchange tubes to the atmosphere.

The above-described prior art cooling arrangement entails a number of drawbacks. For example, the boiling point of the fluid defines the cooling temperature, which means that, in case the fluid is water, the cooling temperature is restricted to 100° C. It would be feasible to change the cooling temperature by altering the pressure, but this entails arranging pressure vessels, which would make the cooling mechanism cumbersome and expensive. In particular, such solution would involve a number of devices requiring high initial costs as well as having high maintenance costs. Another disadvantage is the risk of deposits on the equipment due to the vaporizing of water.

In view of the above, it would be desirable to enable improved cooling of high voltage devices, and in particular cooling of high voltage bushings. Further, it would also be desirable to provide a corresponding method for cooling such bushings.

SUMMARY OF THE INVENTION

It is an object of the present invention to provide an improved cooling of high voltage bushings within an electrical power distribution system. More specifically, it is an object of the invention to provide external cooling means for a bushing, thereby overcoming or at least alleviating the above-mentioned drawbacks of the prior art.

It is another object of the present invention to provide an improved cooling of bushings that is adequate also for very high voltages and currents. In particular, it is an object of the present invention to provide external cooling means able to handle high voltages and currents.

It is yet another object of the present invention to provide cooling means for cooling bushings without increasing the size of the constituent parts when increasing the dissipated power in the bushing by increasing the current and voltage levels.

These objects, among others, are achieved by a high voltage bushing and method.

In accordance with the invention a high voltage bushing is provided, which may be cooled by means of an external cooling system. The bushing is for example suitable for transferring high voltage and current from a fluid-cooled HVDC valve. The high voltage bushing comprises an insulating body surrounding an electrical conductor, wherein the electrical conductor is electrically connectable to a high voltage device, for example connectable to a connector of a HVDC valve. In accordance with the invention, the electrical conductor of the high voltage bushing is connectable to an external cooling system, for example the cooling system of the HVDC valve. By means of the invention the design of a bushing is significantly simplified, as the temperature of the conductor and the insulation material of the bushing is kept under control. In particular, the size of the bushings does not have to be increased although higher currents and voltages are utilized. Further, adequate cooling of bushings is accomplished even for high currents and high voltage levels, for example ranging from 500 kV DC up to 800 kV DC and further up to very high voltage levels.

In accordance with an embodiment of the invention, the external cooling system is the cooling system of a HVDC valve. This provides an inventive way of cooling bushings by utilizing the already existing and utilized cooling fluid of the HVDC valve and therefore enables a cost-efficient and reliable cooling.

In accordance with another embodiment of the invention, the electrical conductor of the high voltage bushing comprises a cooling duct having one or more fluid channels. Such fluid channels could be separate channels in fluid connection with each other in at least one point and arranged to receive circulating cooling fluid on high electric potential from the HVDC valve through the electrical conductor. The high voltage bushing may thus be connected to the fluid cooling system of the external cooling system by means of the one or more fluid channels.

Further, the one or more fluid channels are preferably integrated with the electrical conductor of the high voltage bushing. A size and cost-efficient solution is thereby provided.

In accordance with yet another embodiment of the invention, the electrical conductor comprises an internal fluid pipe, whereby separate channels are provided. The pipe is arranged to lead cooling fluid in one direction within its interior, and the fluid is led back through the channels created between the outside of the fluid pipe and the cooling duct of the electrical conductor. Simple means for circulating the cooling fluid is thereby provided.

In accordance with another embodiment of the invention, the electrical conductor is provided with a seal impermeable to fluid at its upper end. Preferably, the seal is welded onto the end of the electrical conductor. This feature provides an increased security by providing means to prevent the cooling fluid from migrating into the transformer or other sensitive equipment. Further, since the cap is preferably welded on its end, a permanent connection is provided that may be pressure tested and enables leak detection, further yet increasing the security and also facilitating fault-localizing.

The invention also comprises such method, whereby advantages corresponding to the above are achieved.

Further characteristics, advantages and objects of the invention will become apparent when reading the following detailed description.

DETAILED DESCRIPTION OF PREFERRED EMBODIMENTS

Figure 1:
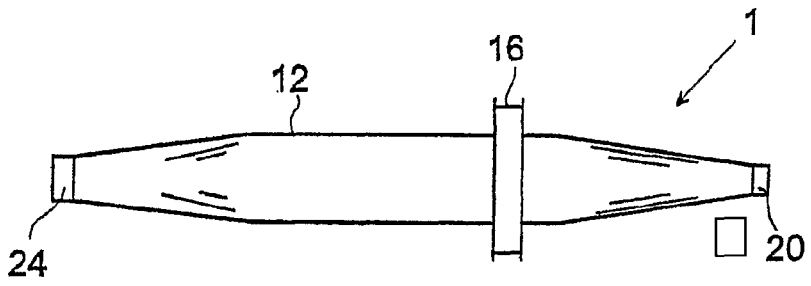
Fig. 1 Prior Art
FIG. 1 is an overall view of a high voltage bushing.

When applicable the same reference numerals are used throughout the description for denoting same or similar parts.

A high voltage bushing is a device used to carry current at high potential through a grounded barrier, for example a wall or an enclosure of an electrical apparatus such as a transformer tank. The bushing keeps current from passing into the grounded barrier by virtue of its insulating properties.

Figure 2:
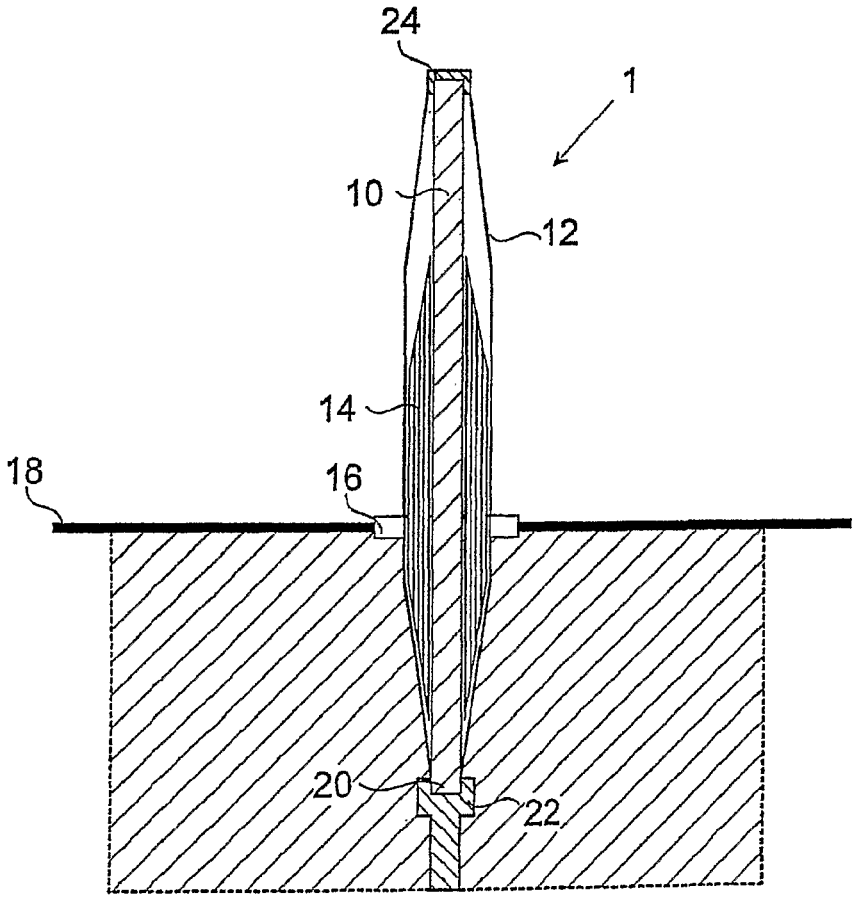
Fig. 2 Prior Art
FIG. 2 is a cross-sectional view of the bushing of FIG. 1 assembled to a transformer housing.

A conventional bushing is shown in FIGS. 1 and 2, wherein the overall structure of a bushing 1 is shown in FIG. 1.

In FIG. 2, a cross-sectional view of the bushing 1 of FIG. 1 is shown mounted to a transformer housing 18. A high voltage conductor 10 runs through the center of a hollow bushing insulator 12, which forms a housing around the high voltage conductor 10. Typically, for an open air application the insulator 12 is made of either porcelain or silicone rubber.

In a condenser bushing, a condenser core 14 is provided within the insulator housing for voltage grading. The voltage stress on the bushing and its surrounding structure includes both AC and DC components. AC component voltage grading depends on the insulation material permittivities. DC component voltage grading depends on the temperature dependent resistivities of the insulation materials. A flange 16 is provided to connect the housing 12 of the bushing to ground through a transformer housing 18. Although a condenser bushing is illustrated in the figure, it is realized that the present invention could be utilized in a non-condenser bushing as well.

The connection of the bushing 1 to internal components of a transformer is also indicated schematically in FIG. 2. The exemplary connection comprises a bottom contact 20 formed by the bottom end portion of the high voltage conductor 10. The bottom contact 20 is provided at the lower, bottom end of the bushing 1 and is arranged to be connected to a mating internal contact 22 provided in the transformer housing 18. Further, an upper outer terminal 24 is provided at the end of the bushing 1 opposite the bottom contact 20 end. The outer terminal 24 is electrically connected to the high voltage conductor 10 through an essentially planar interface and is provided in order to electrically connect the transformer device to external sources.

Other bushings besides the illustrated converter transformer bushing may also benefit from the present invention. In such case, it is noted that other suitable connection means for connecting the bushing to other electrical apparatuses may be utilized. For example, if the teachings of the present invention are used for constructing a wall bushing, the connection means should be suited for this end instead of being connectable to a transformer housing 18.

Figure 3:
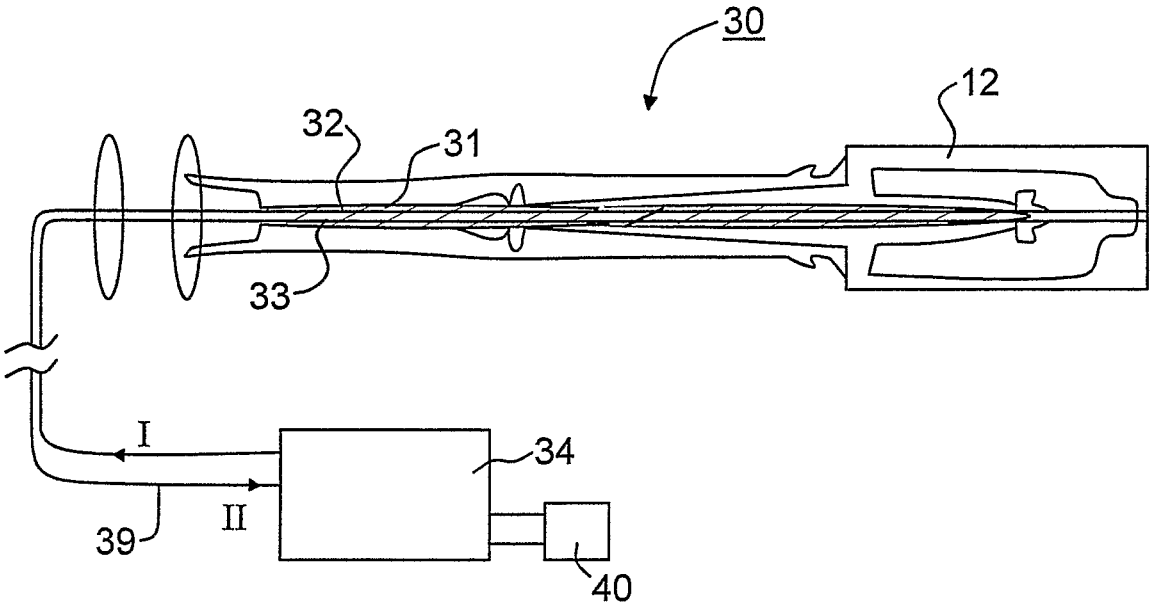
FIG. 3 illustrates schematically an embodiment of the present invention.

FIG. 3 illustrates schematically an embodiment of the present invention, illustrating the innovative bushing 30. The bushing 30 may be a bushing as described above or any other high voltage bushing. A high voltage conductor 31 is housed within the bushing 30. In accordance with the invention, the high voltage conductor 31 of the bushing 30 is provided with one or more channels 32 for conducting cooling fluid, in the present example cooling water, to be described more in detail with reference to FIGS. 4 and 5.

In the following the cooling system of a HVDC valve is used to illustrate the present invention. Conventionally, HVDC valves are cooled by deionized water circulated in a closed loop system. The heat is transferred to a secondary circuit which may be cooled in outdoor coolers. The present invention may be implemented in connection with a HVDC valve that uses deionized water as cooling medium. The cooling means for cooling the HVDC valve may be used also for cooling the bushing.

In FIG. 3, a HVDC valve is schematically illustrated and is indicated by reference numeral 34. Water pipes of the cooling system of the HVDC valve 34 are indicated by reference numeral 39. The arrows I and II indicate the direction of the cooling water (or other fluid). In particular, at I cooling water from the HVDC valve 34 is led to the bushing 30, and at II, slightly heated cooling water returns to the HVDC valve cooling system. As is well known within the field, the cooling system of the HVDC valve 34 may further comprise a deionizer, a pump, a heat exchanger etc. Such parts of the cooling system are schematically indicated at 40.

The cooling fluid of the HVDC valve 34 can be at the same or a different electrical potential as the conductor 31 of the bushing 30. In accordance with the invention only a fraction of the water used to cool the HVDC valve 34 is used to cool the bushing 30. For example, the fraction of the water could range from $1/5000$ up to $1/500$, although more or less water may be needed in dependence on the particular application.

In another embodiment of the invention, the external cooling means is a separate cooling system, i.e. not the cooling system of the HVDC. However, a cooling system similar to the cooling system of a HVDC valve may be used. That is, the cooling medium may be circulated in a closed loop system, the system however being a separate system for cooling the bushing.

Figure 4:
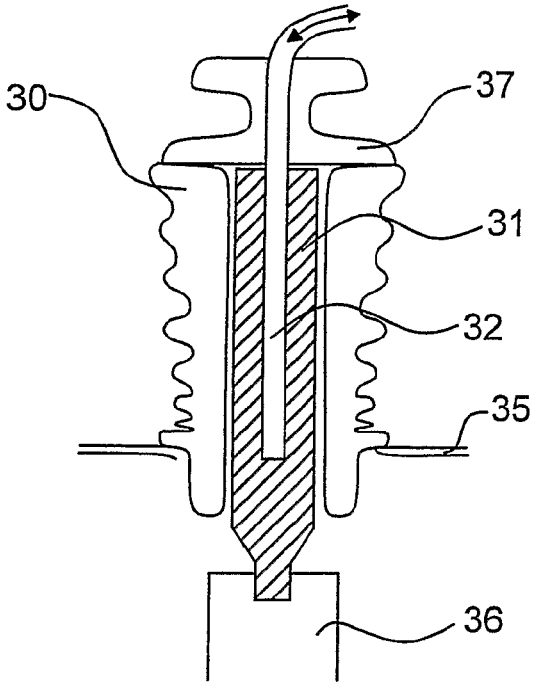
FIG. 4 illustrates the conductor of FIG. 3 within a bushing.

FIG. 4 illustrates the conductor 31 of FIG. 3 within the bushing 30. Reference numeral 35 indicates a grounded housing, for example a transformer tank or a wall. Reference numeral 36 indicates connection means for connecting the bushing 30 to encapsulated electrical apparatus, such as to internal components of a transformer. Reference numeral 37 indicates the connection to, for example, a high voltage network. The bushing 30 could thus serve for connecting an encapsulated electrical apparatus to a high voltage network, although other applications are conceivable. At 32 the innovative fluid cooling means are shown, and the double-headed arrow in the top part of the bushing 30 indicates flowing cooling fluid.

Figure 5:
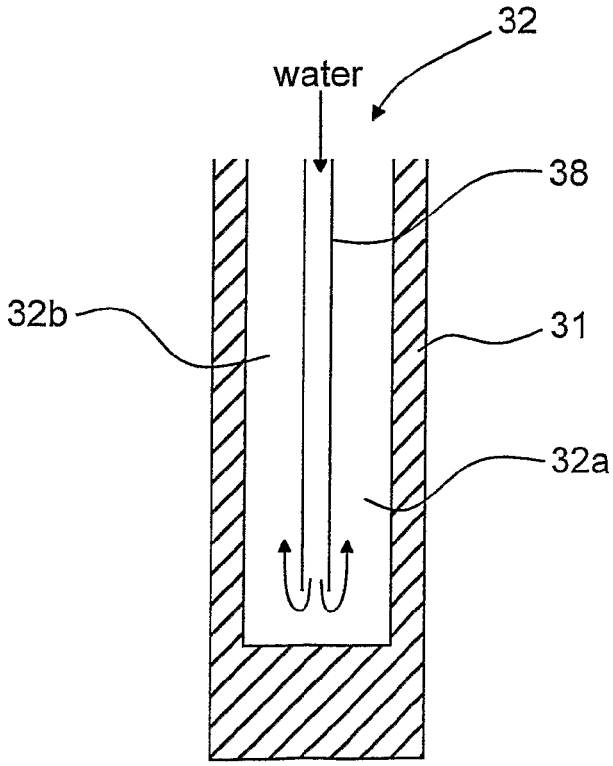
FIG. 5 illustrates the conductor and the innovative cooling channels more in detail.

FIG. 5 illustrates the conductor 31 of the high voltage bushing 30 and the innovative cooling ducts in more detail. One or more cooling ducts 32 are provided integrated with the conductor 31. A water pipe 38 is preferably provided within the cooling duct 32. Cooling water may then be led through the water pipe 38, allowing water to enter within the water pipe 38 and led out on the outside of the water pipe 38. That is, the water pipe 38 is arranged to lead cooling water in one direction within the water pipe 38, and the water is then led through channels 32*a*, 32*b* created between the outside of the water pipe 38 and the interior of the cooling duct 32.

The hollow interior of the conductor 31 housing the cooling duct 32, is preferably not a through hole, thereby reducing the risk of water migrating to electrical devices such as a transformer. The one or more cooling water channels 32*a*, 32*b* are connected to the cooling system for cooling the HVDC valves.

In accordance with one embodiment of the invention, the temperature of the conductor 31 is approximately kept within the range of 40° C. to 80° C., preferably around 60° C. It is realized that the temperature can be supervised and kept at other temperatures as well.

It is to be noted that care should be taken in designing and implementing the present invention, so as to prevent the cooling water from migrating into the transformer or other sensitive equipment. In an embodiment of the invention, the high voltage conductor 31 is provided with a cap welded on its end. Welding provides a permanent connection that may, for example, be pressure tested and enables leak detection.

Figure 6:
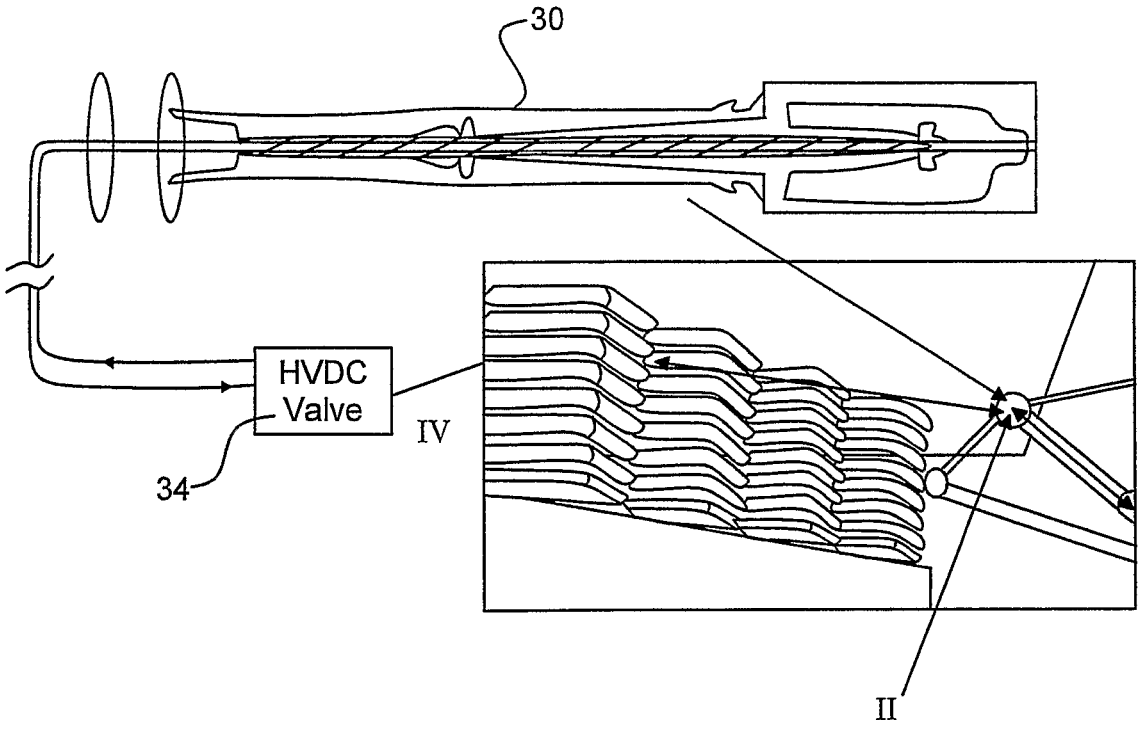
FIG. 6 illustrates a valve hall in which the present invention may advantageously be implemented.

It is realized that other seals impermeable to water may be utilized, as can other means of fastening such seals. FIG. 6 illustrates a HVDC valve hall, and shows schematically how the present invention could easily be implemented in such application. HVDC converter transformers are connected to the HVDC valve by means of a converter transformer bushing. Conventionally, the converter transformer is arranged directly outside the HVDC valve hall with its bushings penetrating into the valve hall. The top of the bushing is then directly connected to the HVDC valve. Arrow II indicates electrical and cooling water connection. Arrow IV indicates one of several HVDC valves within the valve hall.

As mentioned earlier, the cooling fluid of the external cooling system can be at the same or a different electrical potential as the conductor 31 of the bushing 30. Undesired currents that may result from a difference in electrical potentials of the bushing and the cooling fluid should however be dealt with. The cooling system may for example be provided with electrodes for conducting away such undesired currents.

The inventive way of cooling bushings by utilizing already existing and used cooling water enables a cost-efficient and reliable cooling. By means of the invention the design of a bushing will be significantly simplified, as the temperature of the conductor and the insulation material of the bushing is kept under control. For higher voltages, for example 800 kV DC, a prior art bushing would have to become very big in order to carry for example 4000 A. The inventive cooling of the bushing gives a lower diameter of the conductor and thereby a reduced size of the whole bushing.

Further, adequate cooling of bushings is accomplished even for high currents and high voltage levels, for example ranging from 500 kV DC up to 800 kV DC and further up to very high voltage levels.

The present invention is applicable, for example, for converter transformer bushings, valve hall wall bushings and indoor smoothing reactor bushings.

In the preceding detailed description, the invention is described with reference to specific exemplary embodiments thereof. Various modifications and changes may be made thereto without departing from the scope of the invention as set forth in the claims. The specification and drawing are, accordingly, to be regarded in an illustrative rather than a restrictive sense. Thus, although water has been described as a preferred cooling fluid, oil is a possible alternative to that.

The invention claimed is:

1. A high voltage bushing, comprising:

an electrical conductor electrically connected to a high voltage direct current valve and connected to an external fluid cooling system of the high voltage direct current valve;

a cooling duct extending through the electrical conductor and connected to the external fluid cooling system, the cooling duct comprising at least two separate channels within the electrical conductor that are in fluid connection with each other in at least one point, wherein the cooling duct receives closed loop circulating cooling fluid from the external fluid cooling system; and an insulating body surrounding and extending along an exterior of the electrical conductor, wherein the insulating body extends along the at least two separate channels.

2. The high voltage bushing according to claim 1, wherein said circulating cooling fluid is received on high electric potential from said external fluid cooling system through said electrical conductor.

3. The high voltage bushing according to claim 2, wherein said cooling duct is integrated with said electrical conductor of said high voltage bushing.

4. The high voltage bushing according to claim 1, further comprising:

a transfer member configured to transfer high voltage and current from the high voltage direct current valve being fluid cooled.

5. The high voltage bushing according to claim 4, wherein said high voltage bushing is connectable to said fluid cooling system of said high voltage direct current valve with said one or more fluid channels.

6. The high voltage bushing according to claim 1, wherein a fraction of cooling fluid of said high voltage direct current valve fluid cooling system is utilized for cooling said high voltage bushing.

7. The high voltage bushing according to claim 1, wherein said cooling duct of said electrical conductor comprises a fluid pipe extending therethrough and arranged to lead cooling fluid into the cooling duct.

8. The high voltage bushing according to claim 1, wherein said high voltage bushing is arranged for transferring high voltage and current through at least one grounded plane to a transformer.

9. The high voltage bushing according to claim 1, wherein said electrical conductor comprises a seal impermeable to fluid at an upper end of the electrical conductor.

10. The high voltage device according to claim 9, wherein said seal is welded onto said upper end.

11. The high voltage bushing according to claim 1, wherein a temperature of said electrical conductor is kept within the range of 40° C. to 80° C.

12. The high voltage bushing according to claim 1, wherein a coolant in the external fluid cooling system comprises water.

13. The high voltage bushing according to claim 1, wherein the insulating body extends along substantially an entire length of the electrical conductor.

14. A method for cooling a high voltage bushing comprising an insulating body surrounding an electrical conductor electrically connectable to a high voltage direct current valve, the electrical conductor comprising a cooling duct, the cooling duct comprising at least two separate channels that are in fluid connection with each other in at least one point, wherein the cooling duct receives closed loop circulating cooling fluid from an external fluid cooling system of the high voltage direct current valve through the electrical conductor, wherein the insulating body extends along the at least two separate channels, the method comprising:

cooling said high voltage bushing by connecting said electrical conductor of said high voltage bushing to the external fluid cooling system of the high voltage direct current valve via the cooling duct; and receiving closed loop circulating cooling fluid from the external fluid cooling system.

15. The method according to claim 14, wherein said electrical conductor is kept at a temperature within the range of 40° C. to 80° C.

16. The method according to claim 14, wherein a fraction of the cooling fluid of said external fluid cooling system is utilized for cooling said high voltage bushing.

17. The method according to claim 14, wherein said fluid is water.

18. A high voltage system, comprising:

a high voltage direct current valve comprising a fluid cooling system; and a high voltage bushing comprising an electrical conductor electrically connected to the high voltage direct current valve and connected to an external fluid cooling system of the high voltage direct current valve;

a cooling duct extending through the electrical conductor and connected to the external cooling fluid system, the cooling duct comprising at least two separate channels within the electrical conductor that are in fluid connection with each other in at least one point, wherein the cooling duct receives closed loop circulating cooling fluid from the external fluid cooling system; and an insulating body surrounding and extending along an exterior of the electrical conductor, wherein the insulating body extends along the at least two separate channels.

* * * * *